US008376133B2

(12) United States Patent
Macor

(10) Patent No.: US 8,376,133 B2
(45) Date of Patent: Feb. 19, 2013

(54) PROTECTION, AUTHENTICATION, IDENTIFICATION DEVICE FOR A COLLECTABLE OBJECT

(75) Inventor: James J. Macor, Jackson, NJ (US)

(73) Assignee: Goldfinch Design Studio LLC, Jackson, NJ (US)

( * ) Notice: Subject to any disclaimer, the term of this patent is extended or adjusted under 35 U.S.C. 154(b) by 1423 days.

(21) Appl. No.: 11/493,312

(22) Filed: Jul. 26, 2006

(65) Prior Publication Data

US 2008/0023351 A1 Jan. 31, 2008

(51) Int. Cl.
*A45C 1/00* (2006.01)

(52) U.S. Cl. ..... 206/0.8; 206/0.84; 40/661

(58) Field of Classification Search ..... 206/323, 206/0.8, 0.81, 0.84; 40/642.08, 661
See application file for complete search history.

(56) References Cited

U.S. PATENT DOCUMENTS

| | | | | |
|---|---|---|---|---|
| 4,915,214 | A * | 4/1990 | Wieder | 206/0.82 |
| 5,042,650 | A * | 8/1991 | Mayer et al. | 206/0.84 |
| 5,109,977 | A * | 5/1992 | Mayer et al. | 206/0.8 |
| 5,133,451 | A * | 7/1992 | Boyd et al. | 206/0.81 |
| 6,029,807 | A * | 2/2000 | Love | 206/0.82 |
| 6,318,547 | B1 * | 11/2001 | Pianezzola | 206/0.81 |
| 6,366,899 | B1 * | 4/2002 | Kernz | 707/1 |
| 6,529,920 | B1 * | 3/2003 | Arons et al. | 715/268 |
| 6,814,227 | B2 * | 11/2004 | Seligman et al. | 206/0.82 |
| 7,134,546 | B2 * | 11/2006 | Seligman et al. | 206/0.82 |
| 2002/0120611 | A1 | 8/2002 | Kernz | |
| 2004/0039663 | A1 * | 2/2004 | Kernz | 705/27 |
| 2004/0068898 | A1 | 4/2004 | Macor | |
| 2005/0011772 | A1 * | 1/2005 | Eichenbaum | 206/0.8 |
| 2005/0049888 | A1 * | 3/2005 | Eisenberg et al. | 705/1 |
| 2005/0289061 | A1 | 12/2005 | Kulakowski | |
| 2007/0075861 | A1 * | 4/2007 | Cook et al. | 340/572.1 |
| 2007/0113451 | A1 * | 5/2007 | McDowell et al. | 40/642.02 |
| 2008/0041947 | A1 * | 2/2008 | Hollister et al. | 235/385 |
| 2008/0094223 | A1 * | 4/2008 | Svalesen et al. | 340/572.7 |

OTHER PUBLICATIONS

U.S. Appl. No. 11/479,309, filed May 24, 2007, John C. McDowell.
U.S. Appl. No. 11/479,729, filed May 24, 2007, John C. McDowell.

* cited by examiner

*Primary Examiner* — J. Gregory Pickett
*Assistant Examiner* — Blaine Neway

(57) ABSTRACT

A protection, authentication, identification device for a collectable object is described. The device comprises a holder formed for assembly with at least one collectable object to provide protection and preservation of said collectable object. The holder is further formed to resist disassembly and separation with the collectable object, once it is assembled. The protection, authentication, identification device also comprises a data storage device which comprises data of at least one stored digital image of the collectable object. The data storage device is nondetachably secured to the protection, authentication, identification device. And, the data storage device is compatible with a standard computer system for display and inspection of the digital image of the collectable object by a user to aid the user in the authentication of the collectable object. In some embodiments, for example, the collectable object is a coin.

5 Claims, 7 Drawing Sheets

PROTECTION, AUTHENTICATION, IDENTIFICATION DEVICE FOR A COLLECTABLE OBJECT

FIELD OF THE INVENTION

The present invention relates to the protection, authentication and identification of collectable objects such as coins, stamps, currency and baseball cards.

BACKGROUND OF INVENTION

An industry for authentication, identification and certification of collectables has gained prominence and certification companies such as the Professional Coin Grading Service (PCGS) and the Numismatic Guaranty Corporation (NGC) have developed protective collectable holders to protect collectable objects such as coins, stamps, currency, and baseball cards. They encapsulate the collectable object and provide a professional opinion for condition and authenticity. These certified holders usually contain a standard barcode and/or serial number that are used for processing and basic data storage. The information merely relates to the grade, date and denomination and fails to validate that the collectable object has not been deceptively switched with a similar like kind collectable object that is inferior in grade, damaged, or even counterfeit. Although the certification services provide a tamper resistant holder, there are documented cases of deceptive practices of removing the collectable object (e.g., coin) from one holder and utilizing the barcode label and grade of another certified holder to fraudulently represent a different and uncertified collectable. Additionally, the holder is designed to be small and portable which necessitates a small label that only allows for minimal marking space and certification information. Often times the owner would have a need to utilize a digital image of the collectable object in conjunction with the certification data for certification authentication, marketing, auction and internet sales, and insurance validation. Additionally, the owner or buyer of a collectable objector may want to know additional information relative to the collectable such as historical information, valuations, condition populations and other relevant information. Applicant believes that a better system for the protective housing, authentication and identification of collectable objects is needed.

SUMMARY OF THE INVENTION

In one embodiment of the present invention, a protection, authentication, identification device for a collectable object is described. The device comprises a holder formed for assembly with at least one collectable object to provide protection and preservation of the collectable object. The holder is further formed to resist disassembly and separation with the collectable object, once it is assembled. The protection, authentication, identification device also comprises a data storage device which comprises data of at least one stored digital image of the collectable object. The data storage device is nondetachably secured to the protection, authentication, identification device. And, the data storage device is compatible with a standard computer system for display and inspection of the digital image of the collectable object by a user to aid the user in the authentication of the collectable object. In some embodiments, for example, the collectable object is a coin.

Recognizing the need for an improved protection, authentication, identification device for collectable objects, the following objectives are considered:

It is an important objective of the present invention to provide for a commercially viable certification system and portable holder that provides long-term protection for valuable collectable objects such as rare coins, currency, stamps, baseball cards, etc.

It is another important objective of the present invention to provide improved authenticity detection of a certified holder and the associated collectable object.

It is another important objective of the present invention to provide for a visual identification system to promote authenticity of the certified collectable object by providing the owner with the means for easily accessing and comparing original digital image(s) of the certified collectable object that may be created and stored during the certification process of the collectable object, providing possible unique characteristics of the collectable object (e.g., strike, luster, color, defects, abrasions, centering, date, mintmark, die variations).

It is another important objective of the present invention that it may provide relevant information of the actual collectable object (e.g., grade, certification data, mintages, population survival reports, current valuations, historical data and other attributes) while still maintaining a small and portable sized holder.

It is another important objective of the present invention to provide a user with the means of easily accessing the stored digital image(s) of the collectable object with a standard computer system.

It is another important objective of the present invention to provide a user with the means of utilizing at least one stored digital image of the collectable object for certification verification purposes, collection documentation, and internet marketing or sales of the collectible object.

DETAILED DESCRIPTION OF THE DRAWINGS

Figure 1:
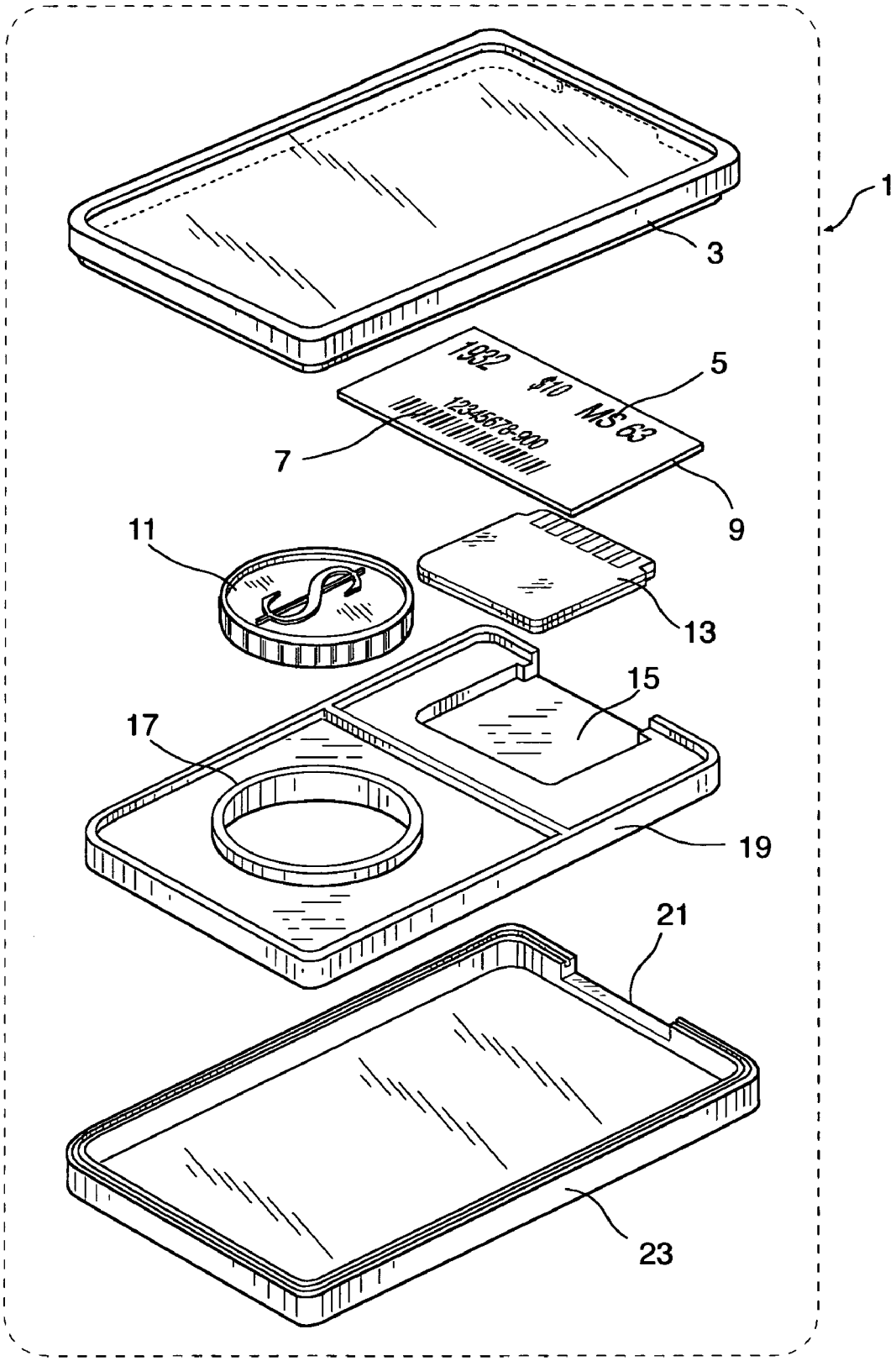
FIG. 1 shows a right front perspective, exploded view of a present invention device shown disassembled.

Referring now to the drawings which are for the purpose of illustrating preferred embodiments of the present invention and are not for the purpose of limiting same, FIG. 1 shows a right front perspective, exploded view of a present invention device shown disassembled. A protection, authentication, identification device for a collectable object 1, is shown comprising a collectible holder having an upper housing 3 and a lower housing 23 that are formed for assembly with a collectable object, such as coin 11. Other collectable objects such as stamps, currency, baseball cards, etc., are additional examples of collectable objects that may be applicable to the present invention. The holder housings 3 and 23 may be made of a clear plastic, such as acrylic, to provide protection and viewing for a collectable object, such as coin 11. A data storage device 13, such as a Flash Memory Card (FMC), is nondetachably secured to the protection, authentication, identification device for a collectable object 1. A Flash Memory Card is illustrated only as an example for it's compact size, and preferred non-volatile memory (NVM) capability, but many other examples of data storage devices could also be used such as a USB flash drive, PC Card, Memory Card, MultiMedia Card, Secure Digital Card, Memory Stick, xD-Picture Card and other compact sized, solid-state data storage devices. For data security reasons, the data storage device 13 may comprise a Read-Only-Memory (ROM) condition that is immutable to prevent a user from altering or erasing the data of the data storage device 13. Immutable shall mean that the data is highly resistant to change or alteration. A core component 19 may secure the collectable coin 11, to a preformed cavity 17 that is cut through core component 19 for viewing coin 11 on both sides, the obverse side (front) and reverse side (rear) of the coin. A cavity 15 may be provided to nest data storage device 13 with core component 19. Core component 19, coin 11, data storage device 13, and barcode label 9 are nondetachably secured with upper housing 3 and lower housing 23 by a method that resists disassembly, such as ultrasonic welding of the upper and lower housings 3 and 23 during an assembly process. Upper housing 3 and lower housing 23 show an example for an access opening 21 that provides for connection of a data storage reader device or electronic cable device to the port end of the data storage device 13. Data storage device 13 is compatible with a standard computer system for display and inspection of at least one digital image of coin 11 by a user to aid the user in the authentication of coin 11. The stored data may also include static (non-changing) predetermined characteristics of collectable coin 11, such as the date of minting, the production mintage, and condition certification grade of coin 11. The digital images of the collectable object can provide authentication and identification of the unique characteristics of the collectable object (e.g., strike, luster, color, defects, abrasions, centering, date, mintmark, die variations). Additional information such as historical information that is associated with coin 11 may also be stored. Data storage device 13 may also contain predetermined external database links, such as the certification service's private network, which may be in the form of Internet Hyperlinks that also provide predetermined characteristics of the collectable coin 11, and other dynamic (changing) data, such as the current certification population and current valuation of coin 11. The external database may include additional security features, such as a user login and password. Collectable object descriptors 5 may provide basic certification information of coin 11, for example, the denomination, the date of mintage, and the certification grade of coin 11. The certification grade of coin 11 may refer to the condition grade of coin 11 as determined by a commercial grading certification service. Barcode 7, when read by an appropriate barcode reader may also provide predetermined characteristics of coin 11 by means of an appropriate barcode reader device.

Figure 2:
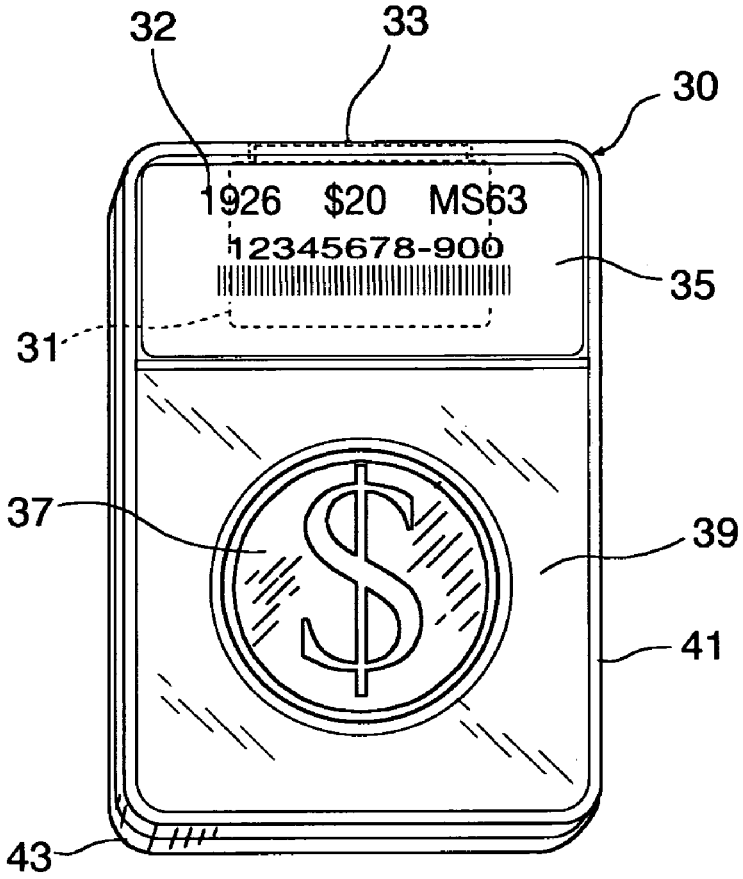
FIG. 2 shows a top plan view of a present invention device similar to that shown in FIG. 1.

FIG. 2 shows a top plan view of a present invention device similar to that shown in FIG. 1. A data storage device 31 (not fully seen in this view), such as a Flash Memory Card (FMC) is nondetachably secured to the protection, authentication, identification device 30, by means of a holder with an upper housing 41 and a lower housing 43 that are formed for assembly with at least one collectable object, such as coin 37. The holder is further formed by a method that resists disassembly, such as ultrasonic welding of the upper and lower housing during an assembly process. This is merely one example of a method that resists disassembly and separation of coin 37, and can promote a nondetachably secured data storage device such as 31 for the protection, authentication and identification of a collectable object 37. Opening 33 provides access for a Memory Storage Reader device, such as a Flash Memory Reader device to electronically attach to Flash Memory Card (FMC) 31. Data storage device 31 is compatible with a standard computer system for display and inspection of at least one digital image of coin 37 by a user to aid the user in the authentication of coin 37. A barcode label 35, when read by an appropriate barcode reader may also provide predetermined characteristics of coin 37. And, collectable object descriptors 32 may also provide basic certification information of coin 37, for example, the denomination, the date of mintage, and the certification grade of coin 37. The certification grade of coin 37 refers to the condition grade of coin 37 as determined by a commercial grading certification service.

Figure 3:
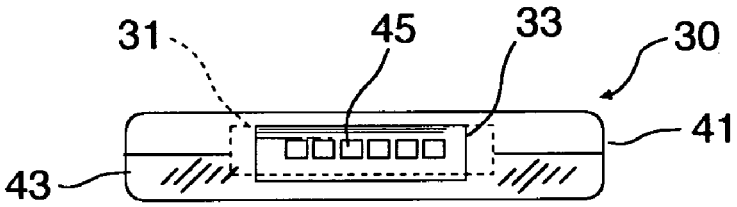
FIG. 3 shows a rear elevation view of the present invention device shown in FIG. 2.

FIG. 3 shows a rear elevation view of the present invention device shown in FIG. 2. Upper housing 41 and lower housing 43 show an example for an access opening 33 that provides for a data storage reader device to electronically attach to the port end of data storage device 31, such as a Flash Memory Card. The location of the access opening 33, that provides interface with data storage device 31, is shown in a rear view only as an example of placement location and could be located at other locations of the present invention, depending on the orientation of data storage device 31 and data storage device port 45. Data storage device 31 is nondetachably secured to the protection, authentication, identification device, by being assembled within the holder, which is formed to resist disassembly.

Figure 4:
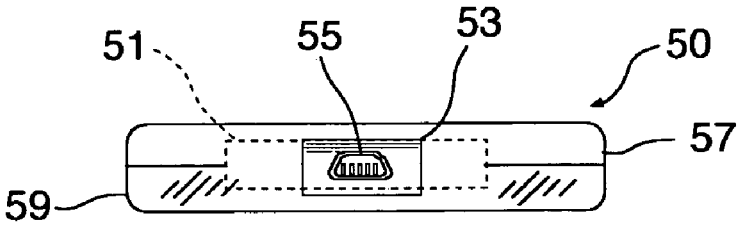
FIG. 4 shows a rear elevation view of a present invention device similar to that shown in FIG. 3.

FIG. 4 shows a rear elevation view of a present invention device similar to that shown in FIG. 3. This rear view shows a protection, authentication, identification device 50, comprising a holder formed and shown assembled, consisting of upper housing 57 and lower housing 59. The holder has been formed for assembly by a method that resists disassembly, for example, by using barbed interlocking tabs (not shown) during an assembly process. Upper housing 57 and lower housing 59 show an example for an access opening 53 that provides for attachment of an electronic Universal Serial Bus (USB) interface device (such as a Universal Serial Bus (USB) cable) to the port end 55 of the data storage device 51 (such as a Universal Serial Bus (USB) type flash drive). Data storage device 51 would preferably have a compact form factor, and may have a non-volatile memory (NVM) condition. For data security reasons, the data storage device 51 may also comprise a Read-Only-Memory (ROM) condition that is immutable to prevent a user from altering or erasing the data of data storage device 51. Immutable shall be defined herein as being resistant to change or alteration. Data storage device 51 is nondetachably secured to the protection, authentication, identification device 50.

Figure 5:
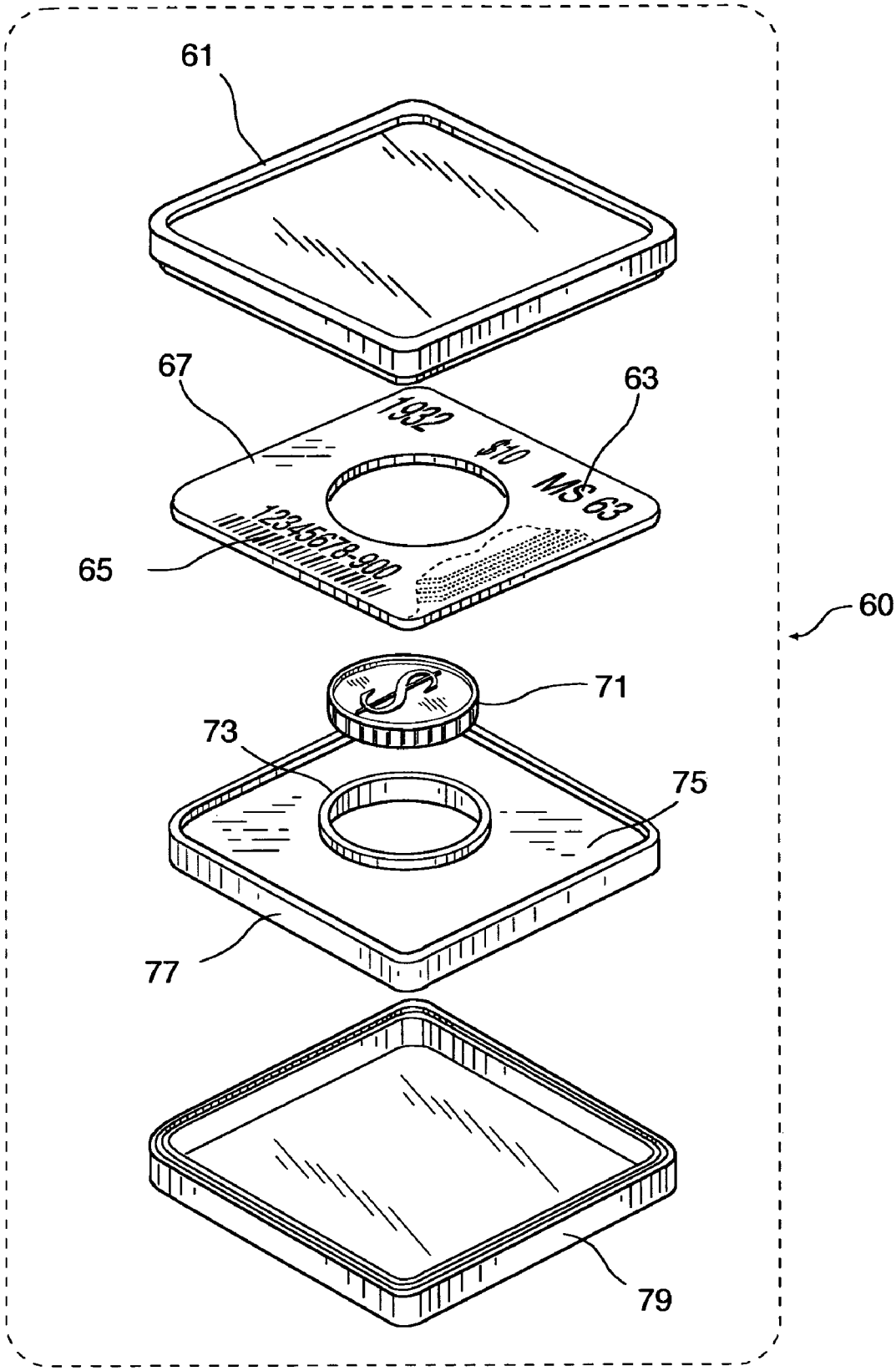
FIG. 5 shows a right front perspective, exploded view of another embodiment of the present invention device shown disassembled.

FIG. 5 shows a right front perspective, exploded view of another embodiment of the present invention device shown disassembled. Protection, authentication, identification device 60, has an upper housing 61 and a lower housing 79 that are formed for assembly to protect and secure a collectable object, such as coin 71 and data storage device 67. Other collectable objects such as stamps, currency, baseball cards, etc., are additional examples of collectable objects that could be applicable to the present invention. The holder may be made of a clear plastic, such as acrylic that provides protection and may provide viewing of the collectable object, such as coin 71. Data storage device 67 may be, for example, a Radio Frequency Identification (RFID) transponder label that has a barcode 65 and collectable object descriptors 63. For data security reasons, the data storage device 67 may comprise a Read-Only-Memory (ROM) condition as to prevent a user from altering or erasing the data of data storage device 67. A core component 77 may be used to secure collectable coin 71, within cavity 73, which is cut through core component 77 for viewing coin 71 on both sides, the obverse side (front) and reverse side (rear) of the coin. The recessed area 75 of core component 77, is formed to receive and hold data storage device 67. Plastic core component 77, coin 71, and data storage device 67 (with barcode 65 and collectable object descriptors 63), are nondetachably secured to the present invention device 60. Upper housing 61 and lower housing 79 are assembled to resist disassembly, by way of ultrasonic welding or other effective means. Data storage device 67 is compatible with an appropriate RFID reader device and a standard computer system for display and inspection of at least one digital image of coin 71 by a user to aid the user in the authentication of coin 71. The stored data may include static (non-changing) predetermined characteristics of collectable coin 71, such as obverse (front) and reverse (rear) digital images, the date of minting, the production mintage, and condition certification grade of coin 71. The digital images of the collectable object provide authentication and identification of the unique characteristics of the collectable object (e.g., strike, luster, color, defects, abrasions, centering, date, mintmark, die variations). Additional information such as historical information that is associated with coin 71 may also be stored. Data storage device 67 may also contain predetermined external database links, such as the private network of the certification service, which may be in the form of Internet Hyperlinks, that also provide predetermined characteristics of collectable coin 71, and other dynamic (changing) data, such as the current certification population and the current valuation of coin 71. The external database may include additional security features, such as a user login and password. Collectable object descriptors 63 may provide basic certification information of coin 71, for example, the denomination, the date of mintage, and the certification grade of coin 71. The certification grade of coin 71 refers to the condition grade of coin 71 as determined by a grading certification service. Barcode 65, when read by an appropriate barcode reader may also provide predetermined characteristics of coin 71 by means of an appropriate barcode reader device.

Figure 6:
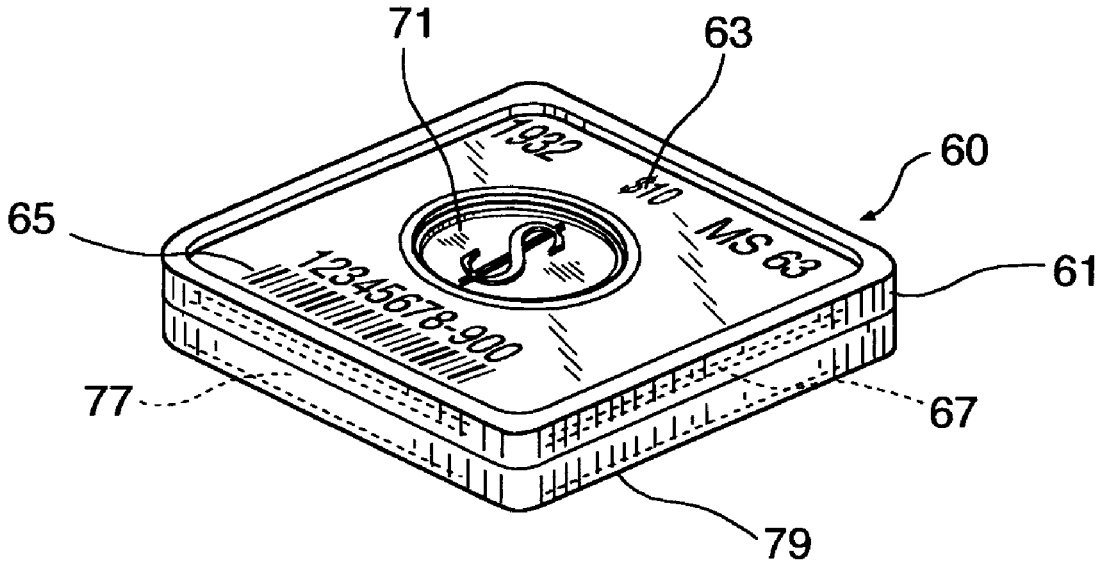
FIG. 6 shows a right front perspective view of the present invention device shown in FIG. 5.

FIG. 6 shows a right front perspective view of the present invention device shown and described in FIG. 5.

Figure 7:
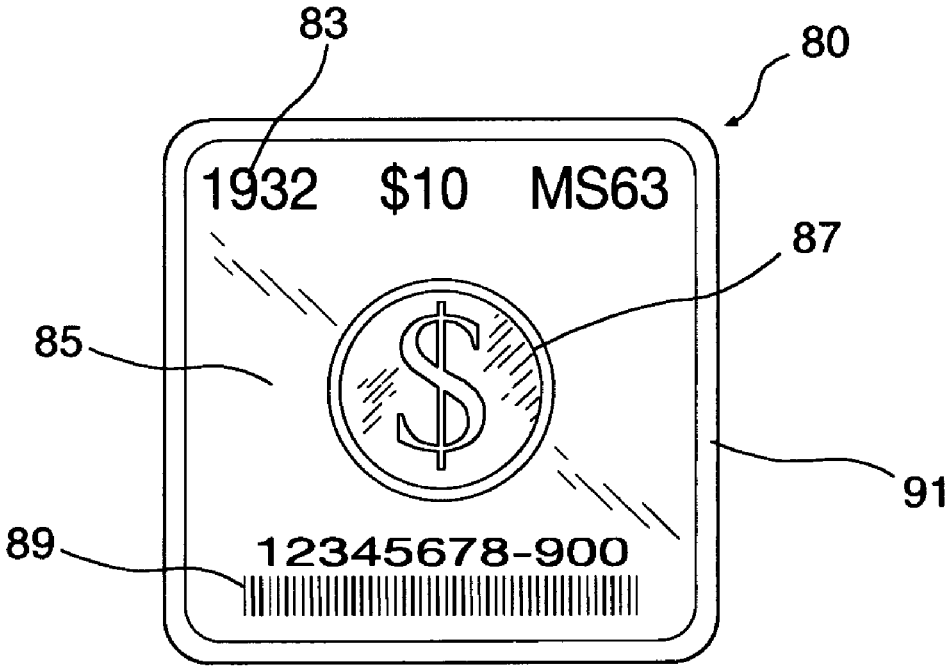
FIG. 7 shows a top plan view of another embodiment of a present invention device.

FIG. 7 shows a top plan view of another embodiment of a present invention device. A protection, authentication, identification device 80, is shown comprising a holder 91 that is formed for assembly to protect a collectable object, such as coin 87. Other possible collectable objects may be stamps, currency, baseball cards, etc. A data storage device such as barcode label 85, is secured within holder 91 which is formed for assembly by a method or means that resists disassembly. Collectable object descriptors 83 may provide basic certification information of coin 87, for example, the denomination, the date of mintage, and the certification grade of coin 87. The certification grade of coin 87 refers to the condition grade of coin 87 as determined by a grading certification service. Barcode 89, when read by an appropriate barcode reader provides predetermined characteristics of coin 87. Barcode 89 may also contain predetermined external database links, such as the certification service's private network, which may be in the form of Internet Hyperlinks that also provide predetermined characteristics of collectable coin 87. The external database may include additional security features, such as a user login and password. Collectable object descriptors 83 may provide basic certification information of coin 87, for example, the denomination, the date of mintage, and the certification grade of coin 87.

Figure 8:
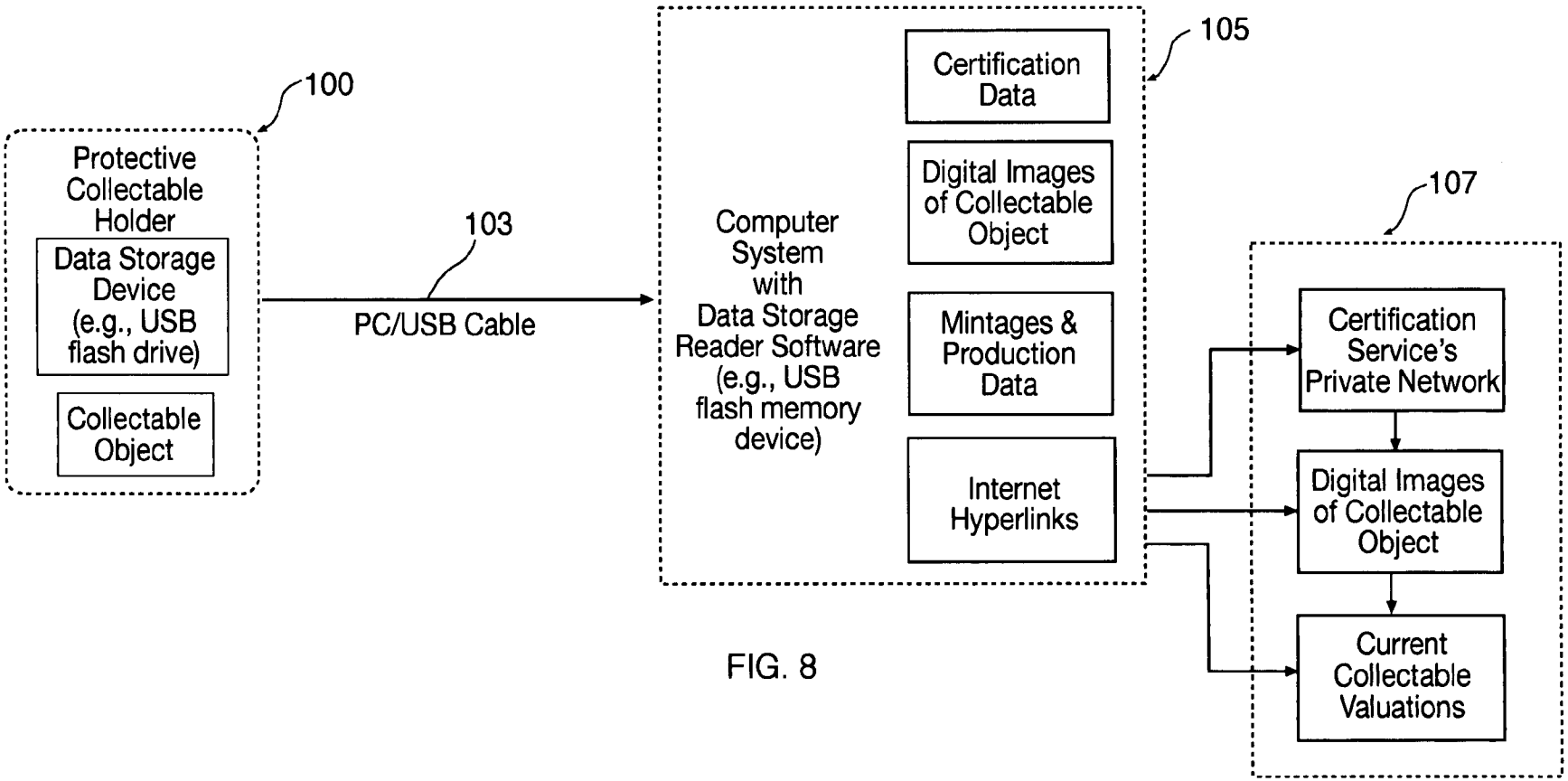
FIG. 8 shows a diagram of a present invention device that is similar to that shown in FIGS. 1, 2, 3 and 4, and a typical corresponding interface with a standard computer system with Internet capability.

FIG. 8 shows a diagram of a present invention device that is similar to that shown in FIGS. 1, 2, 3 and 4, and a typical corresponding interface with a standard computer system with Internet capability. A protection, authentication, identification device 100 for a collectable object includes a holder for at least one collectable object and a data storage device, such as a USB Flash Drive that comprises data of at least one stored digital image of the collectable object. Computer system 105 reads the USB data storage device of the present invention 100 by means of a USB cable 103. The data storage device may also include additional data including additional digital images, certification data, mintages, production data, and Internet Hyperlinks to Internet URL's 107, such as a Certification Service's Private Network that may include for example, digital images of the collectable object, current valuations of the collectable object, etc.

Figure 9:
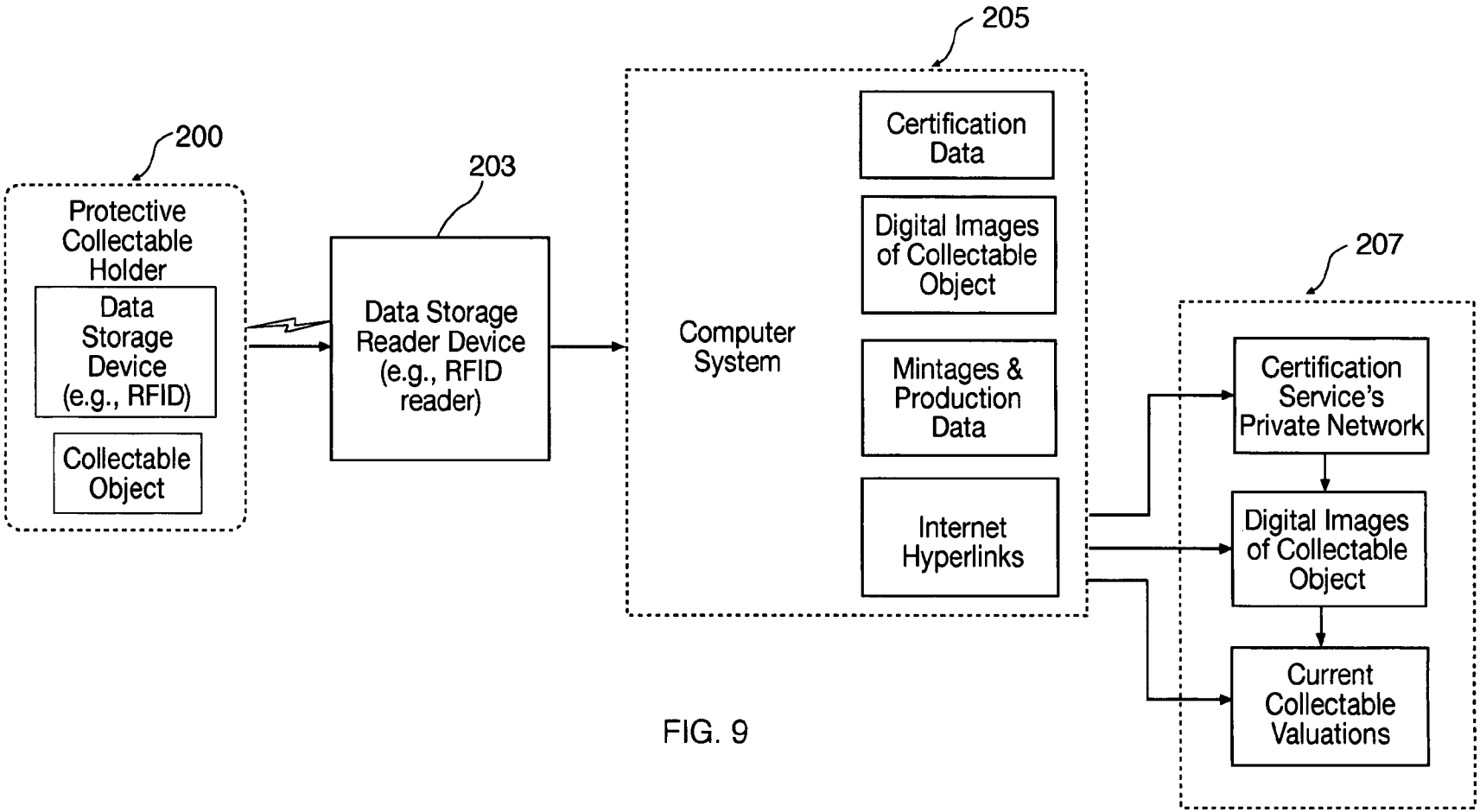
FIG. 9 shows a diagram of a present invention device similar to that shown in FIG. 5 and FIG. 6, and a typical corresponding interface with a standard computer system with Internet capability.

FIG. 9 shows a diagram of a present invention device similar to that shown in FIG. 5 and FIG. 6, and a typical corresponding interface with a standard computer system with Internet capability. A protection, authentication, identification device 200 is shown having a holder for at least one collectable object and a data storage device, such as a RFID transponder label that comprises data of at least one stored digital image of the collectable object. Computer system 205 reads the RFID data storage device of the present invention 200 by means of the appropriate RFID reader device 203. The data storage device may also include additional data including additional digital images, certification data, mintages, production data, and Internet Hyperlinks to Internet URL's 207, such as a Certification Service's Private Network that may include for example, digital images of the collectable object, current valuations of the collectable object, etc.

Figure 10:
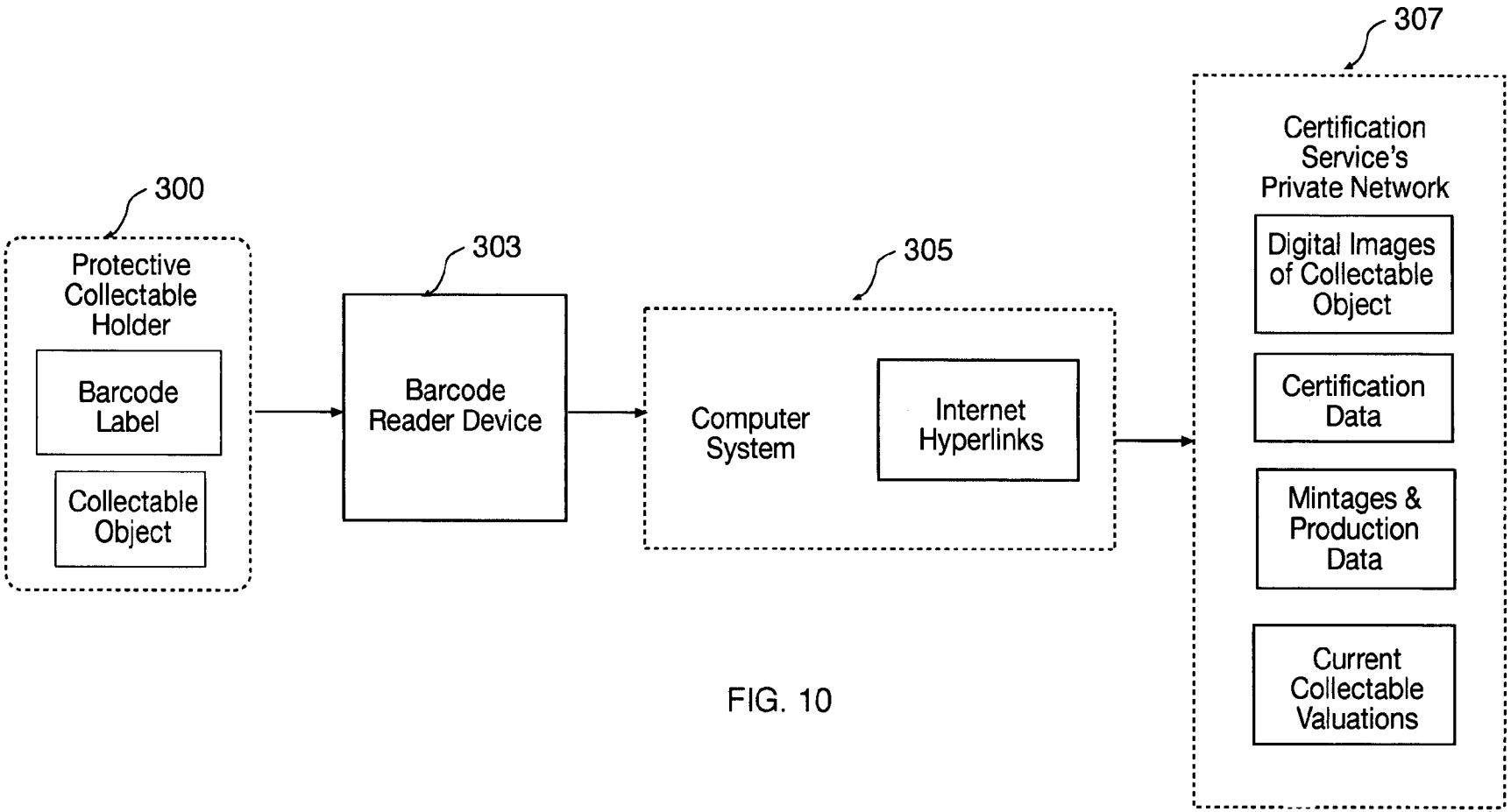
FIG. 10 shows a diagram of a present invention device similar to that shown in FIG. 7, and a typical corresponding interface with a standard computer system with Internet capability.

FIG. 10 shows a diagram of a present invention device similar to that shown in FIG. 7, and a typical corresponding interface with a standard computer system with Internet capability. A protection, authentication, identification device is shown comprising a holder for at least one collectable object and a barcode label. Computer system 305 may read the barcode label of the present invention 300 by means of the appropriate barcode reader device 303. The barcode label may also include Internet Hyperlinks to Internet URL's 307, such as a Certification Service's Private Network that may include for example, digital images of the collectable object, certification data, mintages and production data, current valuations of the collectable object, etc.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A protection, authentication, identification device for a collectable object, said device comprising:

a holder formed for assembly with the collectable object to provide protection and preservation of said collectable object, said holder further being formed so as to resist disassembly and separation with said collectable object; and, an electronic data storage device being nondetachably secured to said protection, authentication, identification device and configured to store at least one digital image of said collectable object, said at least one digital image including sufficient detail to record at least one unique characteristic of the appearance of said collectable object; wherein said electronic data storage device is a solid-state flash memory storage device configured and having sufficient storage capacity to record unique characteristics of the appearance of said collectable object, and said at least one digital image is readable and displayable by a standard computer system connectable to said electronic storage device.

2. The protection, authentication, identification device of claim 1 wherein, said collectable object is a coin, and said at least one unique characteristic is one or more selected from the group including strike, luster, color, defects, abrasions, centering, date, mintmark, and die variations.

3. The protection, authentication, identification device of claim 2, further comprising:

a predetermined external database comprising at least one digital image corresponding to said at least one digital image recorded on said electronic data storage device, so as to assist a user in the authentication of said collectable object.

4. The protection, authentication, identification device of claim 3, wherein said predetermined external database may also provide other predetermined characteristics of said collectable object.

5. The protection, authentication, identification device of claim 3, wherein the collectable object is a coin and said predetermined external database comprises other predetermined characteristics of said coin including at least its date, condition, mintage, population and valuation.

* * * * *